US009190752B1

(12) United States Patent
Little et al.

(10) Patent No.: US 9,190,752 B1
(45) Date of Patent: Nov. 17, 2015

(54) BOARD TO BOARD CONNECTOR ASSEMBLY HAVING IMPROVED TERMINAL ARRANGEMENT

(71) Applicant: HON HAI PRECISION INDUSTRY CO., LTD., New Taipei (TW)

(72) Inventors: Terrance F. Little, Fullerton, CA (US); Wei-Hung Hsu, New Taipei (TW); Ren-Chih Li, New Taipei (TW); Chia-Pin Liu, New Taipei (TW); Margulis Yan, Danvicce, CA (US); Po-Yuan Lin, New Taipei (TW); De-Cheng Zou, Monterey Park, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 30 days.

(21) Appl. No.: 14/260,546

(22) Filed: Apr. 24, 2014

(51) Int. Cl.

| | |
|---|---|
| ***H01R 12/00*** | (2006.01) |
| ***H01R 12/71*** | (2011.01) |
| ***H01R 12/70*** | (2011.01) |
| ***H01R 13/428*** | (2006.01) |

(52) U.S. Cl.
CPC ..... *H01R 12/716* (2013.01); *H01R 12/707* (2013.01); *H01R 13/428* (2013.01)

(58) Field of Classification Search
USPC ..... 439/66, 74, 660
IPC ..... H01R 23/725,23/7073, 12/57, 13/41, H01R 13/658
See application file for complete search history.

(56) References Cited

U.S. PATENT DOCUMENTS

| | | | | |
|---|---|---|---|---|
| 5,915,976 | A * | 6/1999 | McHugh | 439/74 |
| 6,155,886 | A * | 12/2000 | Koseki et al. | 439/736 |
| 7,033,224 | B2 | 4/2006 | Wu et al. | |
| 8,888,508 | B2 * | 11/2014 | Chen | 439/74 |
| 8,961,215 | B2 * | 2/2015 | Hasegawa | 439/346 |
| 2013/0149908 | A1 | 6/2013 | Little et al. | |

FOREIGN PATENT DOCUMENTS

| | | |
|---|---|---|
| CN | 201430254 Y | 3/2010 |

* cited by examiner

*Primary Examiner* — Hien Vu
(74) *Attorney, Agent, or Firm* — Ming Chieh Chang; Wei Te Chung

(57) ABSTRACT

A primary connector (10, 20) includes a primary housing (11, 31) and a number of terminal groups. The primary housing includes a periphery wall (111, 311) and a side wall (112, 312) disposed at opposite sides of the primary housing and extending along a longitudinal direction, a slot (113, 313) defined between the periphery wall and the side wall, and a number of passageways (114, 314) extending along a transverse direction for receiving the number of terminal groups. Each terminal group includes a predetermined terminal (22, 42) having a contact section (221, 421) exposed to the slot and a pair of soldering portions (222, 422) respectively extending from opposite sides of the contact section and inserted outwardly from the periphery wall and the side wall.

9 Claims, 7 Drawing Sheets

BOARD TO BOARD CONNECTOR ASSEMBLY HAVING IMPROVED TERMINAL ARRANGEMENT

BACKGROUND OF THE INVENTION

1. Field of the Invention

The present invention relates to a board to board connector assembly, and more particularly to a board to board connector assembly including a female connector and a male connector mated with each other to establish electrical connection between a mother board and a daughter board.

2. Description of Related Art

U.S. Patent Application Publication No. 20130149908 published on Jun. 13, 2013 discloses a hermaphroditic board to board connector assembly including a female connector and a male connector having same configurations. The female connector has a female housing having a supporting wall and a plurality of female terminals. Each female terminal has a contact section striding across and supported on the supporting wall and a soldering portion extending from the contact section for being soldered on a board. The female terminal is easy to be pelt from the board due to one soldering portion. In addition, the female terminal is short of sufficient resilient force since the contact section strides across and is supported on the supporting wall.

A board-to-board connector assembly having an improved terminal arrangement is desired.

SUMMARY OF THE INVENTION

Accordingly, an object of the present invention is to provide a board-to-board connector assembly comprising a plurality of terminals each having a pair of soldering portions for strengthening the housing and reducing peeling risk from a board.

In order to achieve the object set forth, a primary connector includes a primary housing and a plurality of terminal groups. The primary housing includes a periphery wall and a side wall disposed at opposite sides of the primary housing and extending along a longitudinal direction, a slot defined between the periphery wall and the side wall, and a plurality of passageways extending along a transverse direction perpendicular to the longitudinal direction across the slot. The plurality of terminal groups are secured in corresponding passageways. Each terminal group comprises a predetermined terminal having a contact section exposed to the slot and a pair of soldering portions respectively extending from opposite sides of the contact section and inserted outwardly from the periphery wall and the side wall.

The soldering portions are dually provided to be soldered on a mother board, to thereby strengthen the primary housing and reduce the peeling risk from a mother board.

Other objects, advantages and novel features of the invention will become more apparent from the following detailed description when taken in conjunction with the accompanying drawings.

DETAILED DESCRIPTION OF THE PREFERRED EMBODIMENT

Figure 1:
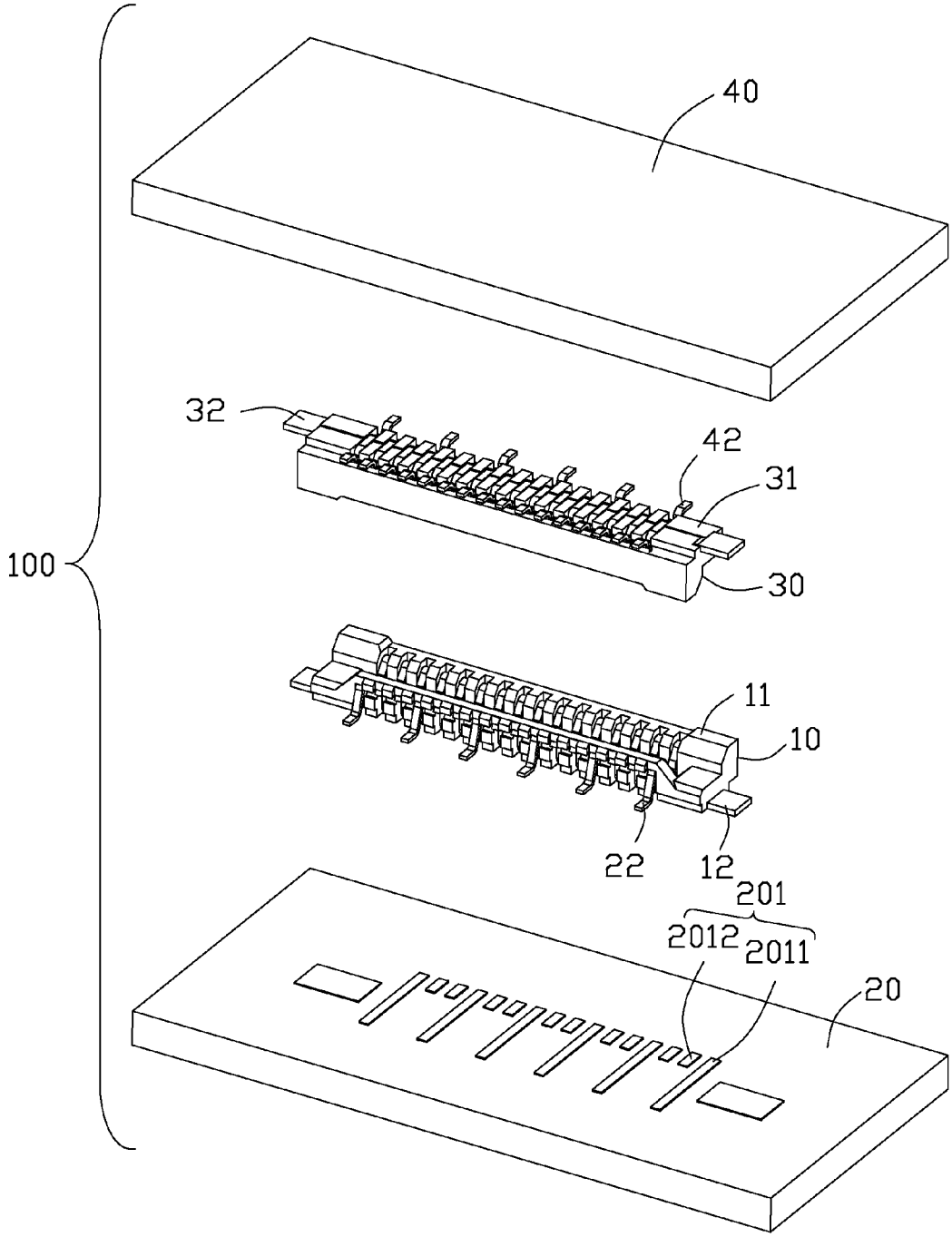
FIG. 1 is a partly exploded perspective view showing a board to board connector assembly in accordance with the present invention.

Reference will now be made in detail to the preferred embodiment of the present invention. Referring to FIG. 1, a hermaphroditic board-to-board connector assembly 100 comprises a female connector 10, a mother board 20, a male connector 30, and a daughter board 40. The female connector 10 and the male connector 30 have same configurations. One of the female connector 10 and the male connector 30 could be designated into a primary connector and the other one of the female connector 10 and the male connector 30 could be designated into a mating connector. Either the mother board 20 or the daughter board 40 could be designated into a primary board.

Figure 3:
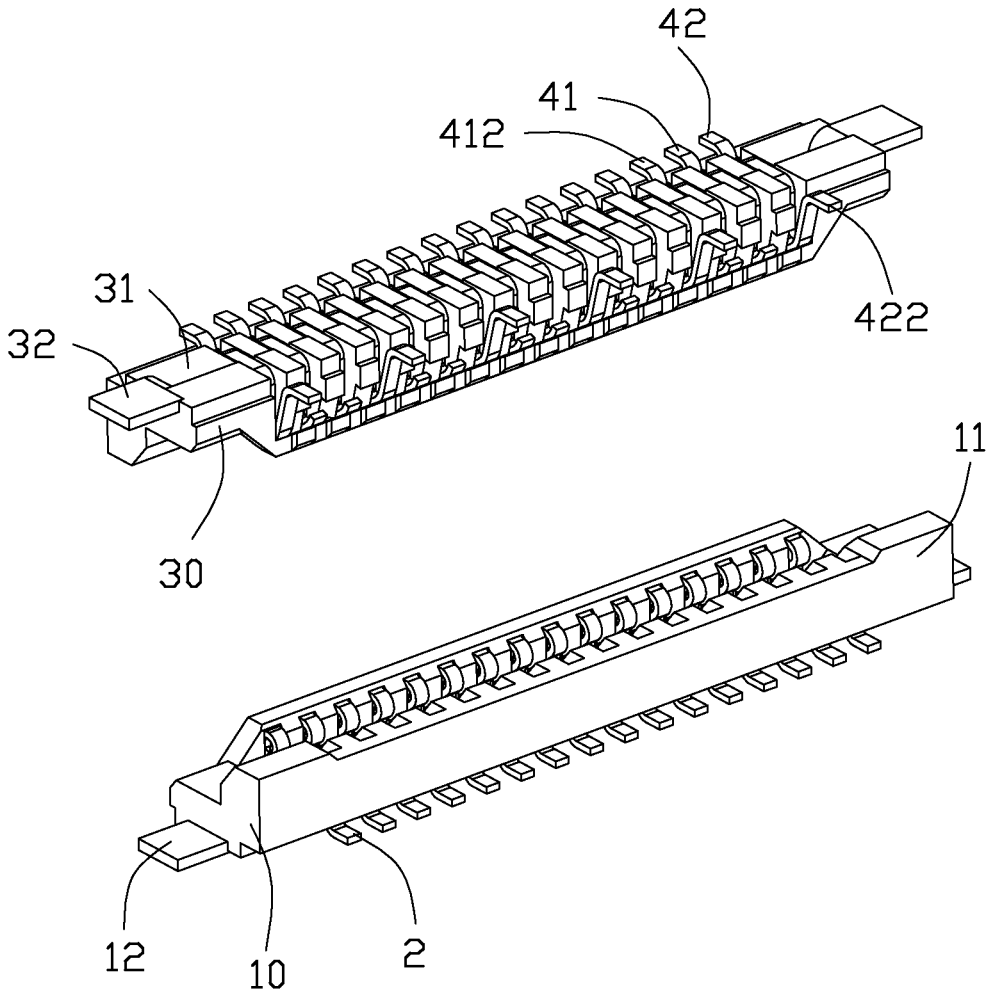
FIG. 3 is a perspective view showing the female connector separated from the male connector.
Figure 4:
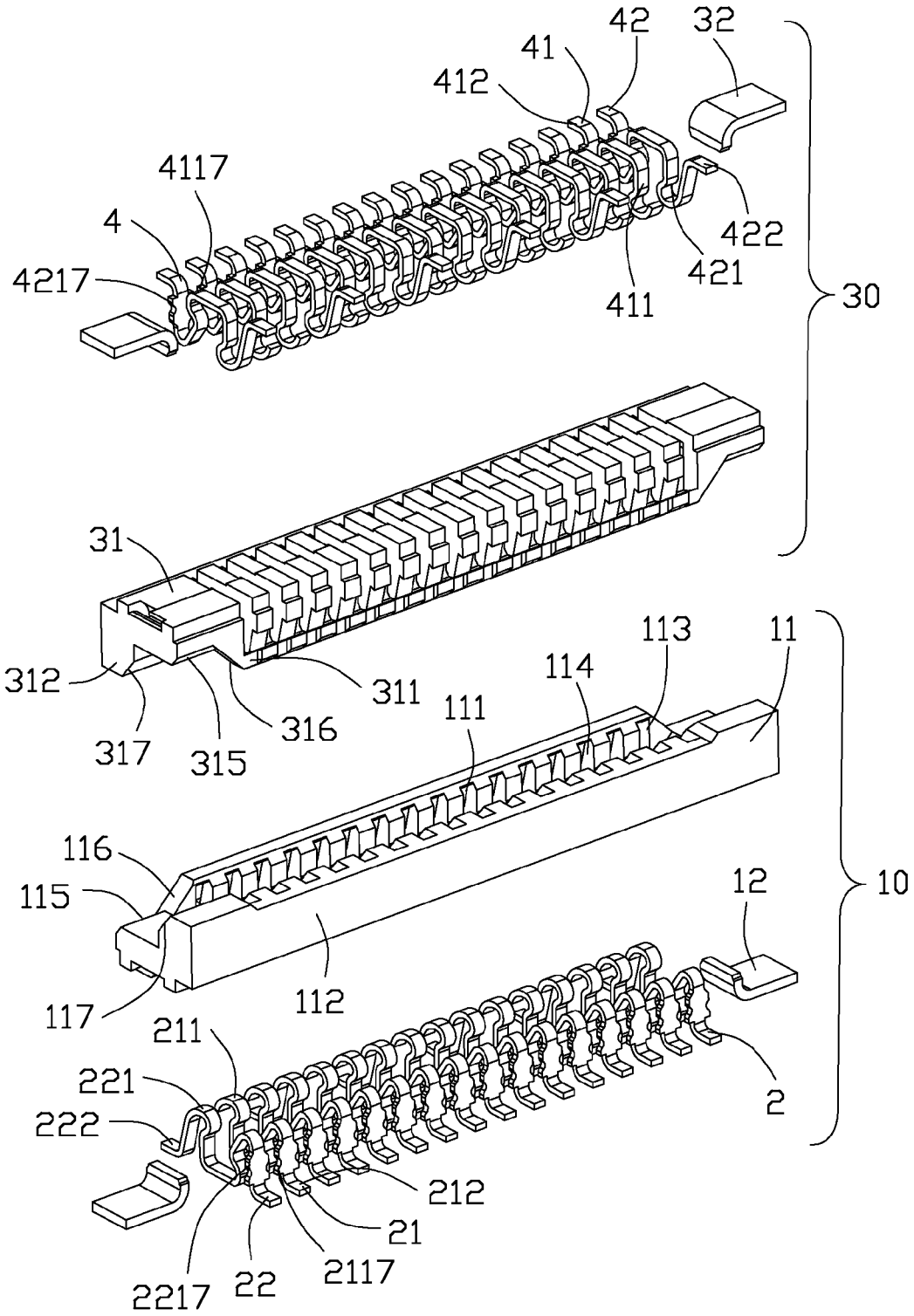
FIG. 4 is an exploded view showing the female connector and the male connector.
Figure 5:
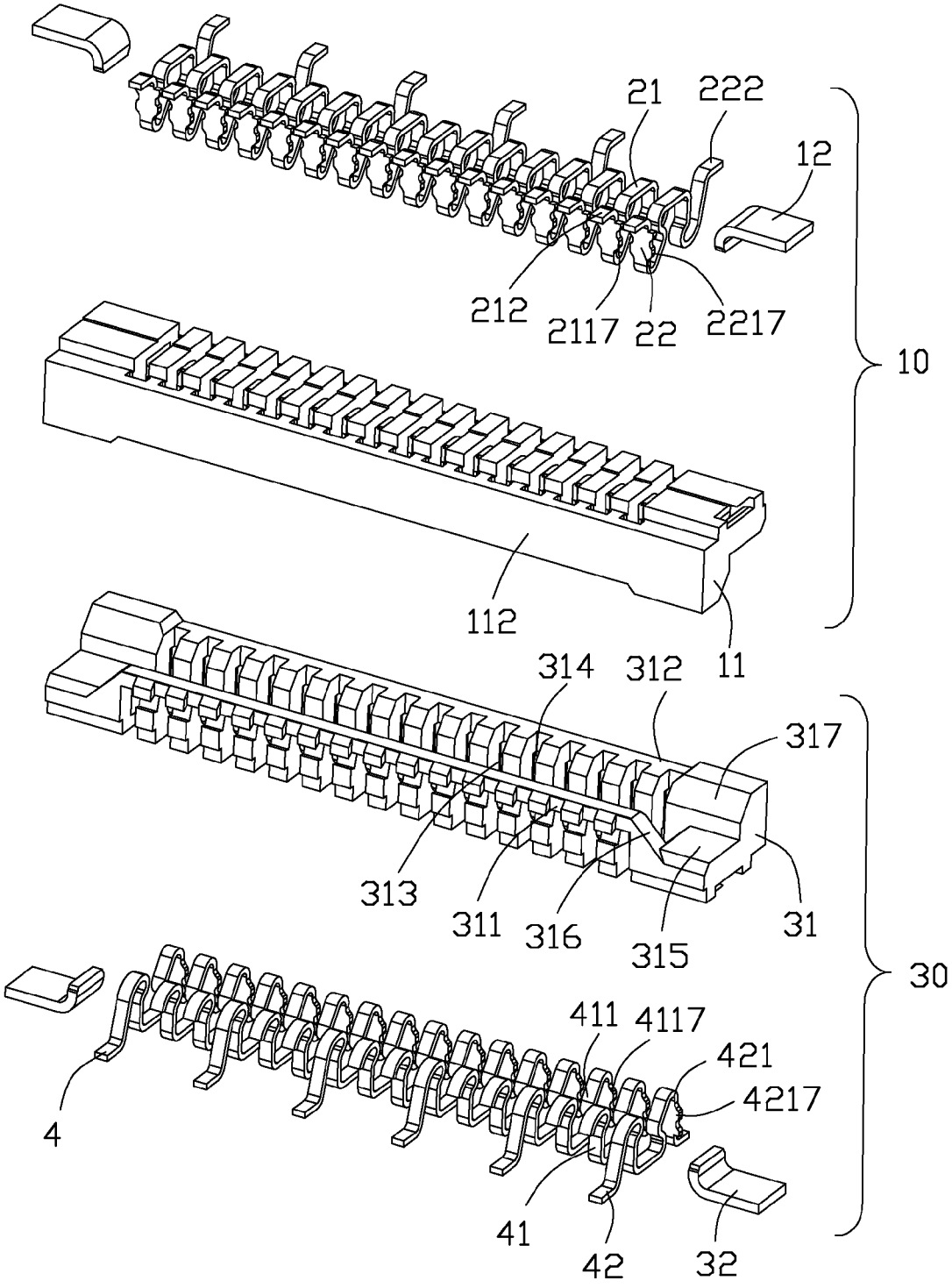
FIG. 5 is another exploded view similar to FIG. 4, taken from another aspect.

Referring to FIGS. 3-5, the female connector 10 includes a female housing 11, a plurality of female terminals 2 secured in the female housing 11 and a pair of female mounting portions 12.

The female housing 11 includes a female periphery wall 111 and a female side wall 112 disposed at opposite sides of the female housing 11 and extending along a longitudinal direction, a female slot 113 defined between the female periphery wall 111 and the female side wall 112, and a plurality of female passageways 114 extending along a transverse direction perpendicular to the longitudinal direction across the female slot 113 through the female periphery wall 111 and the female side wall 112.

The female housing 11 includes a female stepped portion 115 connected with the female side wall 112. The female side wall 112 defines an inclining face 117 facing to the female stepped portion 115. The female periphery wall 111 defines an oblique face 116 facing to the female stepped portion 115.

The plurality of female terminals 2 comprise a plurality of female terminal groups. Each female terminal group comprises a female grounding terminal 22, and a pair of female signal terminals 21 arranged at one side of the female grounding germinal 22. Each female signal terminal 21 has a female signal contact section 211 exposed to the female slot 113 and a single female signal soldering portions 212 extending from the female signal contact section 211 and inserted outwardly from the female side wall 112.

Figure 7:
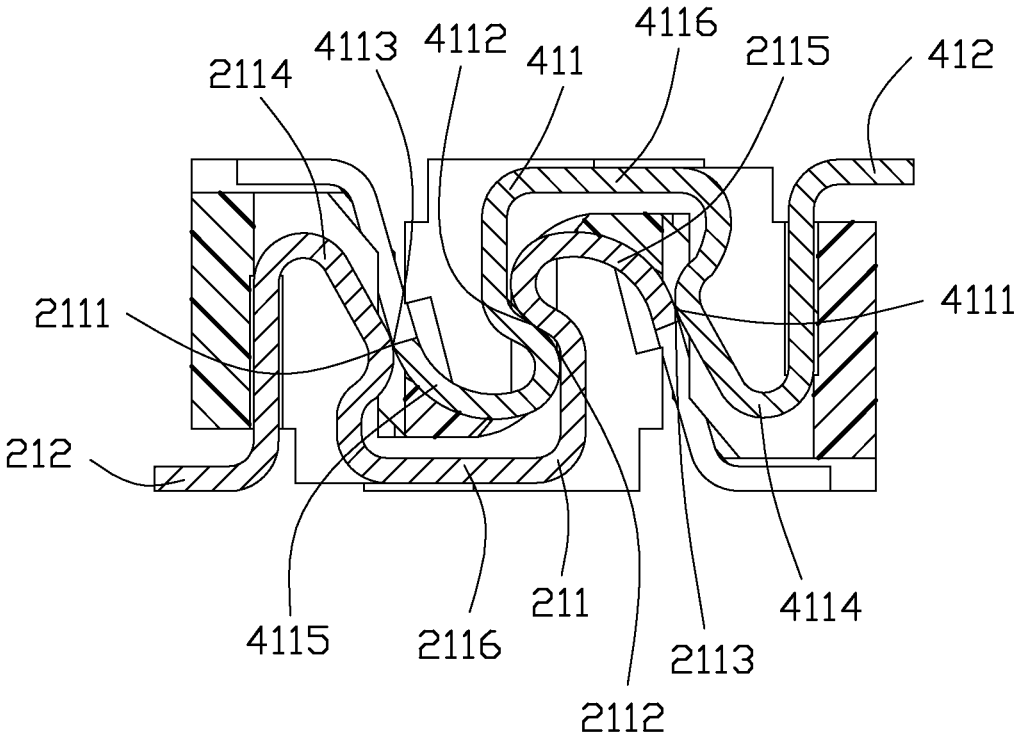
FIG. 7 is a cross-sectional view of the male connector and the female connector, taken along line 7-7 of FIG. 2.

In conjunction with FIG. 7, each female signal contact section 211 includes a first female signal compressible portion 2114, a second female signal compressible portion 2115 and a female signal connecting portion 2116 connected with the first and second female signal compressible portions 2114, 2115. The first female signal compressible portion 2114 abuts against the female side wall 112 and has a first female signal contact point 2111 formed thereon. The second female signal compressible portion 2115 has a second and a third female signal contact points 2112, 2113 oppositely formed thereon. The first female signal compressible portion 2114 is formed with a plurality of click portions 2117 functioning as the so-called retention section and having an interference with the corresponding female passageway 114.

Referring to FIG. 4, each female grounding terminal 22 has a female grounding contact section 221 exposed to the female slot 113 and a pair of female grounding soldering portions 222 extending from opposite sides of the female grounding contact section 221 and inserted outwardly from the female side wall 112 and the female periphery wall 111. In each female terminal group, there are one female signal soldering portion 212 and two female grounding soldering portions 222 arranged adjacent to the female side wall 112, and there are only one female signal soldering portion 212 arranged adjacent to the female periphery wall 111.

Figure 6:
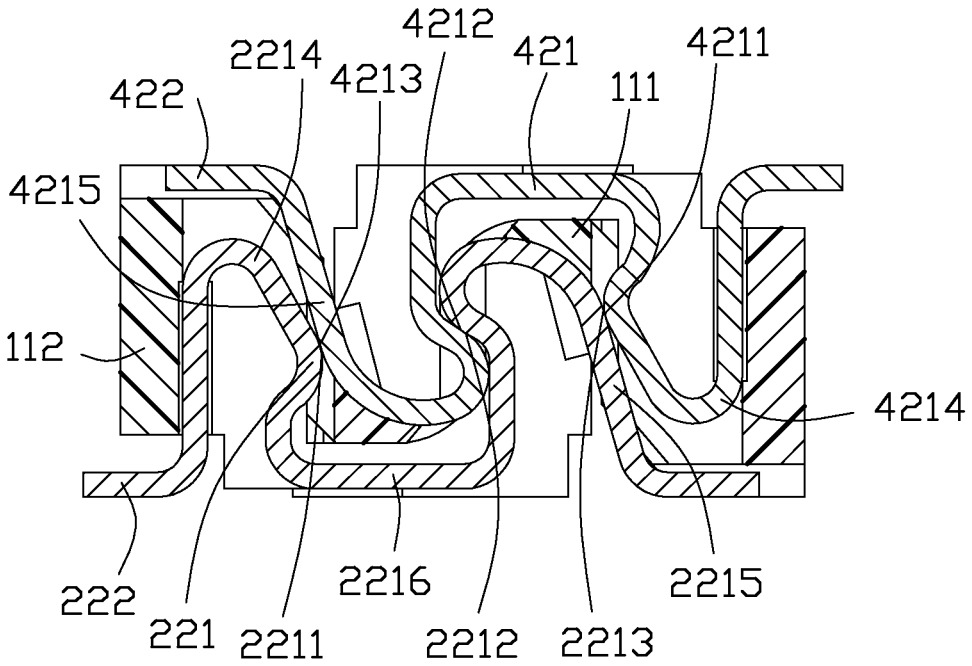
FIG. 6 is a cross-sectional view of the male connector and the female connector, taken along line 6-6 of FIG. 2.

In conjunction with FIG. 6, each female grounding contact section 221 includes a first female grounding compressible portion 2214, a second female grounding compressible portion 2215 and a female grounding connecting portion 2216 connected with the first and second female grounding compressible portions 2214, 2215. The first female grounding compressible portion 2214 and the second female grounding compressible portion 2215 are respectively substantially n-shaped. The first female grounding compressible portion 2214 abuts against the female side wall 112 and has a first female grounding contact point 2211 formed thereon. The second female signal grounding portion 2215 has a second and a third female grounding contact points 2212, 2213 oppositely formed thereon. The first female grounding compressible portion 2214 is formed with a plurality of click portions 2217 having an interference with the corresponding female passageway 114.

Referring to FIG. 1, the mother board 20 includes a plurality of soldering pad groups 201 with which the female signal soldering portions 212 and the female grounding soldering portions 222 are soldered. Each soldering pad group 201 includes a grounding pad 2011 having a length complying with a distance between the pair of female grounding soldering portions 222 of the female grounding terminal 22 for being soldered with the pair of female grounding soldering portions 222 simultaneously, and a pair of signal pads 2012 at one side of the grounding pad 2011 for being soldered with the female signal soldering portions 212 respectively.

Referring to FIGS. 3-5, the male connector 30 includes a male housing 31, a plurality of male terminals 4 secured in the male housing 31 and a pair of male mounting portions 32.

The male housing 31 includes a male periphery wall 311 and a male side wall 312 disposed at opposite sides of the male housing 31 and extending along the longitudinal direction, a male slot 313 defined between the male periphery wall 311 and the male side wall 312, and a plurality of male passageways 314 extending along the transverse direction across the male slot 313 through the male periphery wall 311 and the male side wall 312.

The male housing 31 includes a male stepped portion 315 connected with the male side wall 312. The male side wall 312 defines an inclining face 317 facing to the male stepped portion 315. The male periphery wall 311 defines an oblique face 316 facing to the male stepped portion 315.

The plurality of male terminals 4 comprise a plurality of male terminal groups. Each male terminal group comprises a male grounding terminal 42, and a pair of male signal terminals 41 arranged at one side of the male grounding germinal 42. Each male signal terminal 41 has a male signal contact section 411 exposed to the male slot 313 and a single male signal soldering portion 412 extending from the male signal contact section 411 and inserted outwardly from the male side wall 312.

In conjunction with FIG. 7, each male signal contact section 411 includes a first male signal compressible portion 4114, a second male signal compressible portion 4115 and a male signal connecting portion 4116 connected with the first and second male signal compressible portions 4114, 4115. The first male signal compressible portion 4114 abuts against the male side wall 312 and has a first male signal contact point 4111 formed thereon. The second male signal compressible portion 4115 has a second and a third male signal contact points 4112, 4113 oppositely formed thereon. The first male signal compressible portion 4114 is formed with a plurality of click portions 4117 having an interference with the corresponding female passageway 314.

Referring to FIGS. 4 and 5, each male grounding terminal 42 has a male grounding contact section 421 exposed to the male slot 313 and a pair of male grounding soldering portions 422 extending from opposite sides of the male grounding contact section 421 and inserted outwardly from the male side wall 312 and the male periphery wall 311. In each male terminal group, there are one male signal soldering portion 412 and two male grounding soldering portions 422 arranged adjacent to the male side wall 312, and there are only one male signal soldering portion 412 arranged adjacent to the male periphery wall 311.

In conjunction with FIG. 6, each male grounding contact section 421 includes a first male grounding compressible portion 4214, a second male grounding compressible portion 4215 and a male grounding connecting portion 4216 connected with the first and second male grounding compressible portions 4214, 4215. The first male grounding compressible portion 4214 and the second male grounding compressible portion 4215 are respectively substantially n-shaped. The first male grounding compressible portion 4214 abuts against the male side wall 312 and has a first male grounding contact point 4211 formed thereon. The second male signal grounding portion 4215 has a second and a third male grounding contact points 4212, 4213 oppositely formed thereon. The first male grounding compressible portion 4214 is formed with a plurality of click portions 4217 having an interference with the corresponding male passageway 314.

The daughter board 40 has a configuration substantially same to that of the mother board 20.

Figure 2:
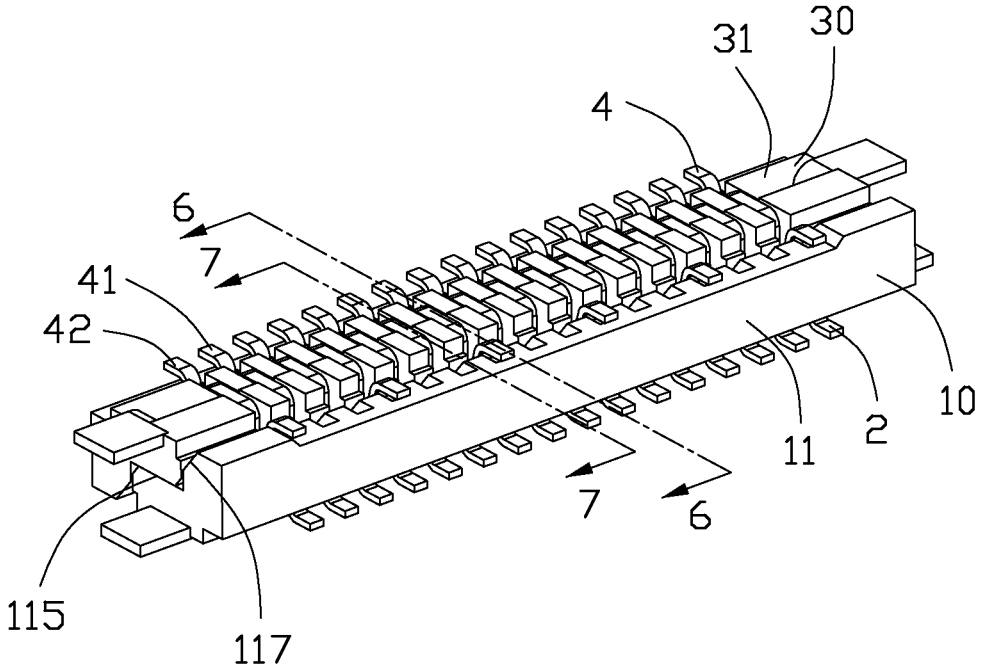
FIG. 2 is an assembled perspective view showing a female connector and a male connector.

Referring to FIGS. 2, 6 and 7, when the male connector 30 mates with the female connector 10, the male periphery wall 311 of the male connector 30 is received in the female slot 113. The female periphery wall 111 of the female connector 10 is received in the male slot 313. The male stepped portion 315 cooperates with the female stepped portion 115. The female oblique face 116 and the female inclining face 117, the male oblique face 316 and the male inclining face 317 perform an anti-mismatching function, respectively.

The first through third female signal contact points 2111-2113 contact with the third through first male signal contact points 4113-4111, respectively. The first through third female grounding contact points 2211-2213 contact with the third through first male grounding contact points 4213-4211, respectively.

The female grounding soldering portions 222 are dually provided to be soldered onto the mother board 20 reliably, to thereby strengthen the female housing 11 onto the mother board 20 and reduce the peeling risk from the mother board 20. So do the male connector 30. The female grounding contact section 221 abuts against an inner side of the female side wall 112 and is compressibly disposed at the inner side of the female side wall 112. The female grounding contact section 221 has first and second female signal compressible portions 2214, 2215 and totally disposed at the inner side of the female side wall 112, to thereby achieve sufficient resilient force.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. A board to board connector assembly, comprising a primary connector and a mating connector for mating with the primary connector, the primary connector including:

a primary housing including a periphery wall and a side wall disposed at opposite sides of the primary housing and extending along a longitudinal direction, a slot defined between the periphery wall and the side wall, and a plurality of passageways extending along a transverse direction perpendicular to the longitudinal direction across the slot; and a plurality of terminal groups secured in corresponding passageways, each terminal group comprising a predetermined terminal having a contact section exposed to the slot and a pair of soldering portions respectively extending from opposite sides of the contact section and extended outwardly from the periphery wall and the side wall;

wherein said predetermined terminal is constituted into a grounding terminal, each terminal group further comprises a pair of signal terminals arranged at one side of the grounding germinal, and each signal terminal includes a contact section exposed to the slot and a single soldering portion extended outwardly from the side wall;

wherein in each terminal group, there are three soldering portions of the grounding terminal and the signal terminals arranged adjacent to the side wall, and there are one soldering portion of the grounding terminal arranged adjacent to the periphery wall;

wherein said mating connector includes a mating housing and a plurality of terminal groups configured substantially same to the primary housing and the plurality of terminal groups of the primary connector, respectively, and the mating housing defines a slot receiving the periphery wall of the primary connector; and wherein said primary housing includes a stepped portion connected with the side wall, said periphery wall defines an oblique face facing to the stepped portion, and the side wall defines an inclining face facing to the stepped portion.

2. The board to board connector assembly as claimed in claim 1, further comprising a primary board having a plurality of soldering pad groups with which the soldering portions of the terminal groups are soldered, each soldering pad group including a predetermined pad having a length complying with a distance between the pair of soldering portions of the predetermined terminal.

3. The board to board connector assembly as claimed in claim 1, wherein said contact section of the predetermined terminal includes a pair of substantially n-shaped compressible portions and a connecting portion connected with the pair of compressible portions.

4. The board to board connector assembly as claimed in claim 3, wherein said one compressible portion has one contacting point and the other compressible portion has two contacting points formed thereon for contacting with a mating terminal.

5. The board to board connector assembly as claimed in claim 1, wherein each passageway extends through the periphery wall and the side wall.

6. A hermaphroditic board to board connector comprising:

an insulative housing defining a pair of side walls opposite to each other in a transverse direction and each of the pair of the side walls extending along a longitudinal direction perpendicular to said transverse direction;

a slot defined between said pair of side walls along said longitudinal direction and exposed to an exterior in a vertical direction perpendicular to both said transverse direction and said longitudinal direction;

a plurality of passageways disposed in the housing along said slot, each of said passageways spanning in the transverse direction; a plurality of contacts disposed in the corresponding passageways, respectively, each of said contacts extending from one side wall to the other and unitarily defining in sequence a surface mounting tail section essentially extending outwardly around a bottom face of the housing under said one side wall in the transverse direction, a first compressible portion forming a first downward opening and having a retention section upwardly extending from the tail section and intimately confronting an inner surface of said side wall and securing to the housing, a second compressible portion forming a second downward opening and connected to the first compressible portion via a connecting portion around said bottom face of the housing; wherein the housing and the contacts are configured to allow the contacts to be assembled into the corresponding passageways upwardly from the bottom face of the housing, and each of said contacts defines a first contacting point on the first compressible portion, and a second contacting point and a third contacting point both on the second compressible portion for mating with another identical connector;

wherein the first compressible portion is essentially exposed to said exterior upwardly while the second compressible portion is essentially protectively under the other side wall;

wherein said contacts are categorized with a pair of signal contacts and arranged at one side of grounding contacts, each of said grounding contacts further includes surface mounting tail sections linked to the first and second compressible portions and extending outwardly beyond the pair of side walls in the transverse direction;

wherein said surface mounting tail sections are located at positions to directly confront the side walls of said another identical connector in the vertical direction; and wherein each signal contact has only a single mounting tail section extended outwardly from one of the pair of side walls.

7. The hermaphroditic board to board connector as claimed in claim 6, wherein the second compressible portion forms a protrusion toward the first compressible portion in said transverse direction where the second contacting point is located.

8. The hermaphroditic board to board connector as claimed in claim 6, wherein each of said passageways extends through the other side wall to allow the third contacting point to be exposed to the exterior in the transverse direction for mating.

9. The hermaphroditic board to board connector as claimed in claim 6, wherein each of said contacts is essentially deflected in a cantilevered manner with a root at the retention section.

* * * * *